United States Patent [19]

Endo

[11] Patent Number: 4,813,403

[45] Date of Patent: Mar. 21, 1989

[54] VIBROSTIMULATIVE DEVICE

[75] Inventor: Yoichi Endo, Tokyo, Japan

[73] Assignee: Ken Hayashibara, Okayama, Japan

[21] Appl. No.: 235,965

[22] Filed: Aug. 17, 1988

Related U.S. Application Data

[63] Continuation of Ser. No. 28,175, Mar. 18, 1987, abandoned.

[30] Foreign Application Priority Data

Apr. 1, 1986 [JP] Japan ..... 61-72435

[51] Int. Cl.[4] ..... A61H 1/00

[52] U.S. Cl. ..... 128/32; 128/33

[58] Field of Search ..... 128/39, 33, 38, 40, 128/32, 44, 67, 43, 64

[56] References Cited

U.S. PATENT DOCUMENTS

| | | | |
|---|---|---|---|
| 1,898,652 | 2/1933 | Williams | 128/38 |
| 2,574,601 | 11/1951 | Swanson | 128/38 |
| 2,821,191 | 1/1958 | Paii | 128/33 |
| 2,920,617 | 1/1960 | Boiarsky . | |
| 4,023,566 | 5/1977 | Maao | 128/33 |
| 4,055,170 | 10/1977 | Nohmura | 128/33 |
| 4,114,215 | 9/1978 | Santo | 128/33 |
| 4,175,552 | 11/1979 | Johnson | 128/32 |
| 4,258,706 | 3/1981 | Shank | 128/33 |

FOREIGN PATENT DOCUMENTS

| | | |
|---|---|---|
| 821271 | 11/1951 | Fed. Rep. of Germany . |
| 833423 | 3/1952 | Fed. Rep. of Germany . |
| 859054 | 12/1952 | Fed. Rep. of Germany . |
| 2356481 | 2/1975 | Fed. Rep. of Germany . |
| 209355 | 12/1983 | Japan . |
| 52-828 | 4/1985 | Japan . |
| 52827 | 4/1985 | Japan . |
| 209284 | 10/1985 | Japan . |
| 216870 | 10/1985 | Japan . |

*Primary Examiner*—Edgar S. Burr
*Assistant Examiner*—Huong Q. Pham
*Attorney, Agent, or Firm*—Browdy and Neimark

[57] ABSTRACT

Disclosed is a vibrostimulative device comprising an oscillator for generating an electric signal of the most effective frequency for the subject; an amplifier; a vibration generator, e.g. loudspeaker, connected with the oscillator through the amplifier; a vibratory member to be placed on the body of the subject; and a compressed closed gas space for transmitting the vibration from the vibration generator to the vibratory member.

12 Claims, 2 Drawing Sheets

VIBROSTIMULATIVE DEVICE

This application is a continuation of application Ser. No. 028,175, filed Mar. 18, 1987, now abandoned.

BACKGROUND OF THE INVENTION

1. Field of the invention

The present invention relates to a device to stimulate the human body with a vibration or a prescribed frequency.

2. Description of the prior art

Japanese Patent Laid-Open No. 209,355/83 discloses a vibrostimulative device wherein a vibratory plate to be placed on the human body is coupled through a closed gas space with a loudspeaker, while its voice coil is connected with a variable oscillator through an amplifier. The device has the advantages that its vibration frequency can be conveniently set to the most effective level for the subject; and that the gas used as the vibration-transmitting media transmits the vibration over a relatively large body area of the subject.

The device, however, has the drawback that, when the closed gas space is extended with a flexible hose having a relatively small diameter, it requires a relatively high power to attain a prescribed sound pressure on the vibratory plate because gases are generally low in vibration transmittability. This unnecessarily enlarges both vibratory plate and amplifier to raise the production cost of the device.

SUMMARY OF THE INVENTION

In view of the foregoing, the main object of the present invention is to provide a vibrostimulative device wherein these drawbacks of conventional device are overcome.

This and other objects as may become apparent hereinafter have been attained with the vibrostimulative device, comprising an oscillator for generating an electric signal of the most effective frequency for the subject; an amplifier; a vibration generator connected with the oscillator through the amplifier; a vibratory member to be placed on the body of the subject; and a compressed closed gas space for transmitting the vibration from the vibration generator to the vibratory member.

BRIEF DESCRIPTION OF THE DRAWINGS

The present invention will hereinafter be explained with reference to the accompanying drawings in which.

DETAILED DESCRIPTION OF THE PREFERRED EMBODIMENT

Figure 1:
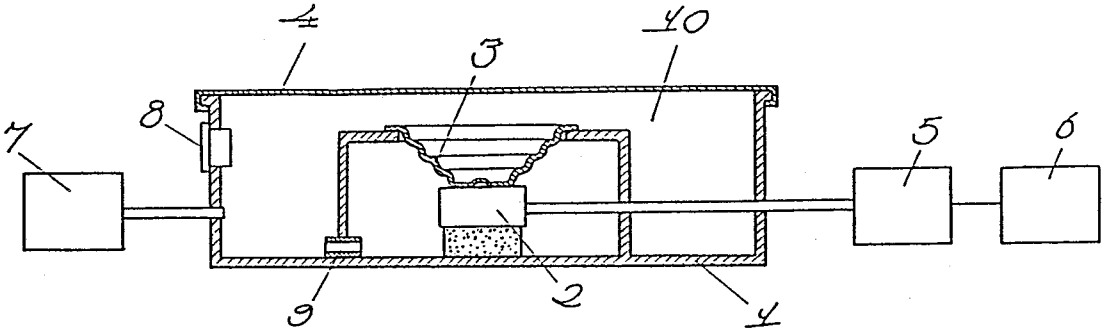
FIG. 1 is the sectional side elevation view of an embodiment according to the invention.

In the drawings, reference numerals 1 and 12 designate box members; 2, loudspeaker; 3, cone; 4, vibratory member; 5, amplifier; 6, oscillator; 7, compressing means; 8, pressure gauge; 9, duct; 10, compressed closed gas space; 11, resilient hollow member; 13, resilient bag member; and 14, one-way restrictor valve.

In the embodiment as shown in FIG. 1, loudspeaker (2) that acts as the vibration generator is placed upwardly at the center of the inside bottom of box member (1) capable of supporting the human body, and the opening of box member (1) is airtightly covered with a resilient metal sheet that acts as vibratory member (4). To the voice coil of loudspeaker (2) is connected variable oscillator (6) through amplifier (5), and compressing means (7) and pressure gauge (8) are provided through box member (1) to retain the compression in box member (1). To equalize the pressures at both sides of cone (3), duct (9) is provided to communicate both sides of cone (3). Duct (9) should be of size that does not make a substantial loss on the vibration from loudspeaker (2). The compression in closed gas space (10) is generally attained by operating compressing means such as compressor or pump in continuous or continual manner.

In this arrangement, variable oscillator (6) is connected with a power source, and the adjusting dial (not illustrated) is then set to a prescribed frequency level. The output of variable oscillator (6) is amplified with amplifier (5), and supplied to the voice coil of loudspeaker (2) to vibrate cone (3) at the frequency. The sound pressure is transmitted through coiimpressed closed gas space (10), formed between loudspeaker (2) and vibratory member (4), to energize vibratory member (4). Thus, by placing vibratory member (4) on the body of the subject, vibration treatment is carried out at the frequency. In this case, the frequency most effective to the subject is selected by first setting the device to the standard frequency, for example, 60 hertz, then gradually varying the frequency.

This embodiment can be favorably used in the form of bed or chair to vibrate the whole body or a relatively large body area of the subject.

Figure 2:
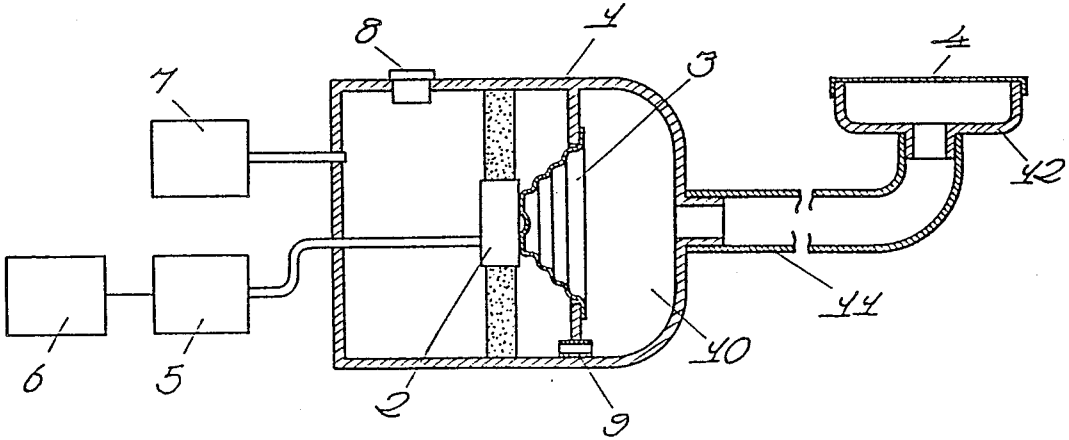
FIG. 2 is the sectional side elevation view of another embodiment according to the invention.

In the embodiment as shown in FIG. 2, loudspeaker (2) that acts as the vibration generator is placed at the center of the inside bottom of box member (1), and one end of resilient hollow member (11) having an airtight structure, such as flexible hose, is jointed to compressed closed gas space (10) that is provided in front of loudspeaker (2) through the wall of box member (1). The other end of resilient hollow member (11) is jointed to another box member (12), and its opening is covered airtightly with a rubber sheet (4). The voice coil of loudspeaker (2) is connected with variable oscillator (6) through amplifier (5), and the pressures at both sides of cone (3) are equalized through duct (9). In order to efficiently transmit the vibration of cone (3) to vibratory member (4), the diameter of cone (3) should be close to that of resilient hollow member (11) as much as possible. The inside of box member (1) should be rounded so that no undesirable resonance arise therein. For the same purpose, the pressure in the device should be increased to the possible highest level where vibratory member (4) inflates to exert satisfactory cushion and attachment feelings. Box member (12) and vibratory member (4) may be arranged in such manner that vibratory member (4) shaped into flat plate, tube or circle as disclosed, for example, in Japanese Patent Laid-Open No. 209,355/83, or Japanese Utility Model Laid-Open Nos. 52,827/85 or 52,828/85, is removably attachable to the affected site, whether in hands, feet, breast, or belly.

This embodiment can be favorably used to effect a vibration treatment by remote operation using an extended flexible hose. In this case, by providing two or more flexible hoses, two or more affected sites of one or more subjects are simultaneously administered with the vibration.

Although the previous embodiments are equipped with a compressing means, the present invention shall not be restricted to those. Any means can be employed as long as the closed gas space is brought into compression when in use: For example, the closed gas space is compressed with compressing means which is removed when in use. In this case, by employing a highly closed structure for the device, the compression can be retained over a long period of time.

Figure 3:
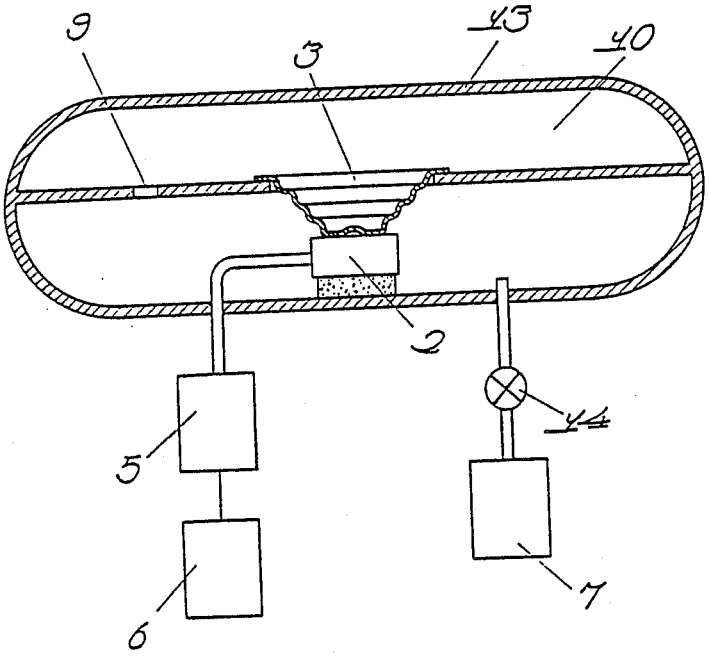
FIG. 3 is the sectional side elevation view of still another embodiment according to the invention.

In the embodiment as shown in FIG. 3, compressing means is omitted by airtightly enclosing loudspeaker (2) in resilient bag member (13) resilient enough to support the body of the subject. The compression in bag member (13) is retained by shaping it into cushion or mattress, and allowing the subject to lay thereon to press bag member (13). The compression in the bag member is controlled by providing one-way restrictor valve (14) through the wall of bag member (13), and connecting compressing means to the valve.

The vibratory member may be made with plastic, rubber or metal as described above. The gas may be carbonated gas or helium gas, and shall not be restricted to air.

The vibration generator is a loudspeaker or an electromagnetic vibration generator, for example, that as disclosed in Japanese Patent Laid-Open Nos. 209,284/85 or 216,870/85; that wherein an air wave of condensation and rarefaction is generated by continually suspending compression of the air; and that wherein an electric motor and a vibratory plate are used in combination.

As described above, since, in the vibrostimulative device according to the invention, the frequency variable vibration generator and the vibratory member transmitting the vibration to the body of the subject are coupled through the compressed closed gas space, the most effective vibration is efficiently transmitted locally or systemically to the subject. Thus, the present invention is characterized in that reduction or suppression of shoulder discomfort, myalgia, low back pain and asthmatic spasm, and improvement of blood circulation is attained with a less amount of electricity than in the case of using conventional device.

Furthermore, since the present invention makes a reduced loss on vibration in the closed gas space, a low-power amplifier and a relatively small vibration generating means can be advantageously used similarly as an extended flexible hose having a relatively small diameter. Because of this, unlike conventional device, the device of the present invention neither becomes bulky nor bothers treatment with its hose.

While preferred embodiments of the invention have been described, such description is for illustrative purpose only, and it is to be understood that changes and variations may be made without departing from the spirit or scope of the following claims.

I claim:

1. A vibrostimulative device for use on a human body, comprising:

(a) an oscillator for generating an electric signal;
(b) an amplifier;
(c) a vibration generator connected with the oscillator through the amplifier;
(d) a first box member enclosing the vibration generator;
(e) a vibratory member to be placed on the human body,
(f) a second box member having an opening covered airtightly with the vibratory member; and
(g) an elastic hollow member for airtightly joining the first box member with the second box member so that a closed gas space is formed in the first and second box members through the elastic hollow member; and compressing means connected with said closed gas space so that said space can be brought into compression during use upon vibration of said vibration generator, thereby vibration is transmitted to said vibratory member.

2. The device of claim 1, wherein said vibration generator is a loudspeaker.

3. The device of claim 1, wherein said vibratory member is made of a rubber, metal or plastic.

4. The device of claim 1, wherein said elastic hollow member is a flexible hose.

5. A vibrostimulative device for use on a human body comprising:

an oscillator generating an electric signal;
an amplifier;
a vibration generator connected with the oscillator through the amplifier;
a box member enclosing the vibration generator and having an opening covered air tightly with a vibratory member adapted to be placed on the human body; and
said vibratory member and at least a portion of said box member comprising an elastic bag member so that a closed gas space is formed in the box member; and
compressing means connected with said closed gas space so that said space can be brought into compression during use upon vibration of said vibration generator, thereby vibration is efficiently transmitted to said vibratory member.

6. The device of claim 5, wherein said elastic bag member is in the form of a cushion.

7. The device of claim 5, wherein said elastic bag member is in the form of a mattress.

8. The device of claim 5, wherein said elastic bag is filled with air.

9. The device of claim 5, wherein said compressing means comprise a pump.

10. The device of claim 5, wherein said compressing means comprises a compressor.

11. The device of claim 1, wherein said compressing means comprises a pump.

12. The device of claim 1, wherein said compressing means comprises a compressor.

* * * * *